US006478492B1

(12) United States Patent
Crystal

(10) Patent No.: US 6,478,492 B1
(45) Date of Patent: Nov. 12, 2002

(54) PLATEN HAVING MEDIA SUCTION AND VAPOR RECOVERY PORTS

(75) Inventor: Kevin Reed Crystal, Chanhassen, MN (US)

(73) Assignee: MacDermid Acumen, Inc., Waterbury, CT (US)

( * ) Notice: Subject to any disclaimer, the term of this patent is extended or adjusted under 35 U.S.C. 154(b) by 5 days.

(21) Appl. No.: 09/251,951

(22) Filed: Feb. 17, 1999

(51) Int. Cl.[7] ..... B41J 11/08

(52) U.S. Cl. ..... 400/656; 400/648

(58) Field of Search ..... 400/656, 648, 400/643, 578; 347/220

(56) References Cited

U.S. PATENT DOCUMENTS

| | | | | | |
|---|---|---|---|---|---|
| 4,572,071 | A | * | 2/1986 | Cappel et al. | 101/183 |
| 4,916,466 | A | * | 4/1990 | Coste | 400/578 |
| 4,992,805 | A | * | 2/1991 | Yoshizawa et al. | 346/134 |
| 5,308,457 | A | * | 5/1994 | Betta et al. | 204/131 |
| 5,737,674 | A | * | 4/1998 | Venkatesan et al. | 399/250 |

FOREIGN PATENT DOCUMENTS

| | | | | |
|---|---|---|---|---|
| EP | 0409596 | * | 1/1991 | |
| JP | 0114681 | * | 5/1988 | 400/656 |
| JP | 6-15998 | * | 6/1994 | |
| JP | 8-112950 | * | 8/1996 | |

* cited by examiner

*Primary Examiner*—Andrew H. Hirshfeld
*Assistant Examiner*—Anthony H. Nguyen
(74) *Attorney, Agent, or Firm*—Carmody & Torrance LLP

(57) ABSTRACT

The apparatus of the present invention thus increases the precision for controlling the movement of a printing media through an improved set of vacuum apertures formed in the platen surface, a discrete set of compartments inside the platen each fluidly coupled to a unique set of improved vacuum apertures, and vapor/dust recovery apertures fluidly coupled to a storage, collection, or other disposal vessel. In a preferred embodiment the present invention comprises at least four exhaust fans each fluidly coupled to a discrete compartment within the platen and at least one said compartment connects to each end of the platen surface adjacent to the printing zone and is adapted to evacuate the entire interior space of a large format printing engine. In each of these embodiments, at least some of the improved vacuum apertures located near the edges of the printing zone extend to a recess, or grooved, segment of the platen surface. Also in each said embodiment of the present invention using a planar, or flat, printing zone, a set of gradually tapering transition platen sections promote the best vacuum seal between the platen (within the printing zone) and the printing media. These gradually tapering transition sections can either be integrated into a monolithic platen member, or may be fabricated separately and suitably attached to the platen. In the embodiments wherein one or more vapor evacuation aperture is ported to a vessel, an appropriate vapor recovery technique may be practiced to capture any potentially harmful vapors or print-artifact producing dust particles. In these embodiments, a suitable recovery technique might include fume incinerator(s), carbon adsorbers, HEPA-quality filter materials, phase change recovery, and the like.

15 Claims, 3 Drawing Sheets

80
70
72
10
28
36

PLATEN HAVING MEDIA SUCTION AND VAPOR RECOVERY PORTS

FIELD OF THE INVENTION

The present invention relates generally to the field of printing. In particular, an apparatus for conforming a printing substrate to a printing zone of a printing platen in a large format ink jet print engine.

BACKGROUND OF THE INVENTION

The present invention addresses a need in the art to simplify assembly and enhance operation of print engine components that interact with a printing substrate to ensure constant contact between a printing media relative to a print zone portion of a printing platen. In large format ink jet print engines one or more blowers coupled to a space having apertures in the printing zone of a platen offer some measure of uniformity for printing operations by creating a suction force which draws the printing media to the platen. Typically, such a suction force is used in addition to tensioned supply and take-up rolls alone or in conjunction with nip/grit roller assemblies driven by an axial shaft. It is known that if the media fails to adequately adhere to the platen while printing the carriage assembly, or a lower portion of print heads, can strike the media and damage either or both the media or the print heads at great cost of time and effort. In fact, oftentimes following such a "head strike" one or more print heads must be replaced due to the damage to the sensitive ink emitting nozzles typically disposed at the lowest portion of said print heads. At the least, a head strike causes loss of print media and ink used to reach the point at which contact occurs. In the event that a head strike occurs during overnight or unattended printing operations all later prints are typically lost and considerable damage to the print heads, carriage drive assembly, and the media often result.

Thus, as a result of the dire consequences attributed to head strikes, and the need for a consistent printing distance for consistent droplet placement, a variety of means for conforming a media to a platen surface have been utilized. The present invention improves on the systems previously utilized while at the same time conveniently solving difficult design issues related to evacuation of potentially harmful vapors, ink dust, and the like.

Driving a printing media through a printing zone using abrasive grit roller/nip roller combinations or with powered take-up media spools have long been known in the art of large format full color ink jet printing. And as long as the grit roller consistently cooperates with a corresponding nip roller to form a discrete, static location for the driving "footprint" which propels the printing media at a constant velocity this technique has been basically successful. However, with the advent of large numbers of individual print heads operating in concert the printing zone necessarily increases in both length and width these prior art media handling mechanisms often fail to maintain conformity between media and platen surface. Any local deviations in the platen surface within the printing zone will typically produce repeatable printing errors in output because such local deviations are necessarily static in nature. Assuming that no other factor affects such deviations implies that the printing errors can be eliminated by characterizing the topography of the printing zone and correcting ink droplet trajectories to compensate for the deviation(s). However, in practice the media can "walk" side to side during printing, the thickness of a given portion of a media web may vary, the rail supporting the print heads may change, the media may stretch from tensioned media drive systems, and the media may swell when receiving ink. Furthermore, the media may cup, distort, or kink as it advances due to a variety of factors; in particular, these types of errors has been observed to occur at the platen edges and near grit/nip roller locations where the media oftentimes bends. Prior art large format print engines were driven by necessity to apply a source of vacuum through the platen surface so that the media adhered to the platen in the critical printing zone. Other prior art large format print engines were equipped with slightly bowed printing zones (in the media web direction) and corresponding orientation of print emitting jets each disposed at the same distance from the printing zone.

Another potential source of error in large format ink jet printers relates to the fact that in the grit/nip roller equipped engines, the roller sets are typically driven by an axial shaft that must be manufactured to a very high straightness tolerance or else the footprint of the rollers on the media will remain the same size but rise and fall as the axial shaft rotates. This produces printing errors and may distort the media unnecessarily and can interfere with the effectiveness of any vacuum seal between the platen surface and the printing media.

The exemplary embodiment of the present invention taught herein address the failings of these prior art media handling mechanisms and the variety of other potential sources of printing error for large format ink jet print engines and is easily adapted for handling a wider variety of printing ink compositions than traditionally used in the large format ink jet printing industry.

The present invention thus finds utility over a variety of printing platforms that create a vacuum seal between platen and media through a vacuum supplied through apertures formed in a printing platen to promote a continuous sealing footprint over the entire printing zone.

SUMMARY OF THE INVENTION

The apparatus of the present invention thus increases the precision for controlling the movement of a printing media through an improved set of vacuum apertures formed in the platen surface, a discrete set of compartments inside the platen each fluidly coupled to a unique set of improved vacuum apertures, and vapor/dust recovery apertures fluidly coupled to a storage, collection, or other disposal vessel. In a preferred embodiment the present invention comprises at least four exhaust blowers each fluidly coupled to a discrete compartment within the platen and at least one said compartment connects to each end of the platen surface adjacent to the printing zone and is adapted to evacuate the entire interior space of a large format printing engine. In each of these embodiments, at least some of the improved vacuum apertures located near the edges of the printing zone extend to a recess, or grooved, segment of the platen surface. Also in each said embodiment of the present invention using a planar, or flat, printing zone, a set of gradually tapering transition platen sections promote the best vacuum seal between the platen (within the printing zone) and the printing media. These gradually tapering, or 'radiused', transition sections can either be integrated into a monolithic platen member, or may be fabricated separately and suitably attached to the platen. In the latter example, the separately fabricated transition sections should preferably be fabricated of inexpensive light weight material to minimize cost and weight without impacting the printing performance of a large format ink jet print engine practicing the present invention. In the embodiments wherein one or more vapor evacuation aperture is ported to a vessel, an appropriate vapor recovery technique may be practiced to capture any potentially harmful vapors or print-artifact producing dust particles. In these embodiments, a suitable recovery technique might include fume incinerator(s), carbon adsorbers, HEPA-quality filter materials, phase change recovery, and the like.

Thus in the preferred embodiments, the inventive apparatus allows a high degree of control over the printing substrate within the printing zone by extending the effective "reach" of certain vacuum apertures near the periphery of the printing zone without requiring extensive under-platen compartments while providing exceedingly consistent printing performance for each print head operating in a large format ink jet printer.

The following figures are not drawn to scale and only detail of a few representative embodiments of the present invention, more embodiments and equivalents of the representative embodiments depicted herein are easily ascertainable by persons of skill in the digital imaging arts.

DESCRIPTION OF PREFERRED EMBODIMENT

Figures 1, 1A:
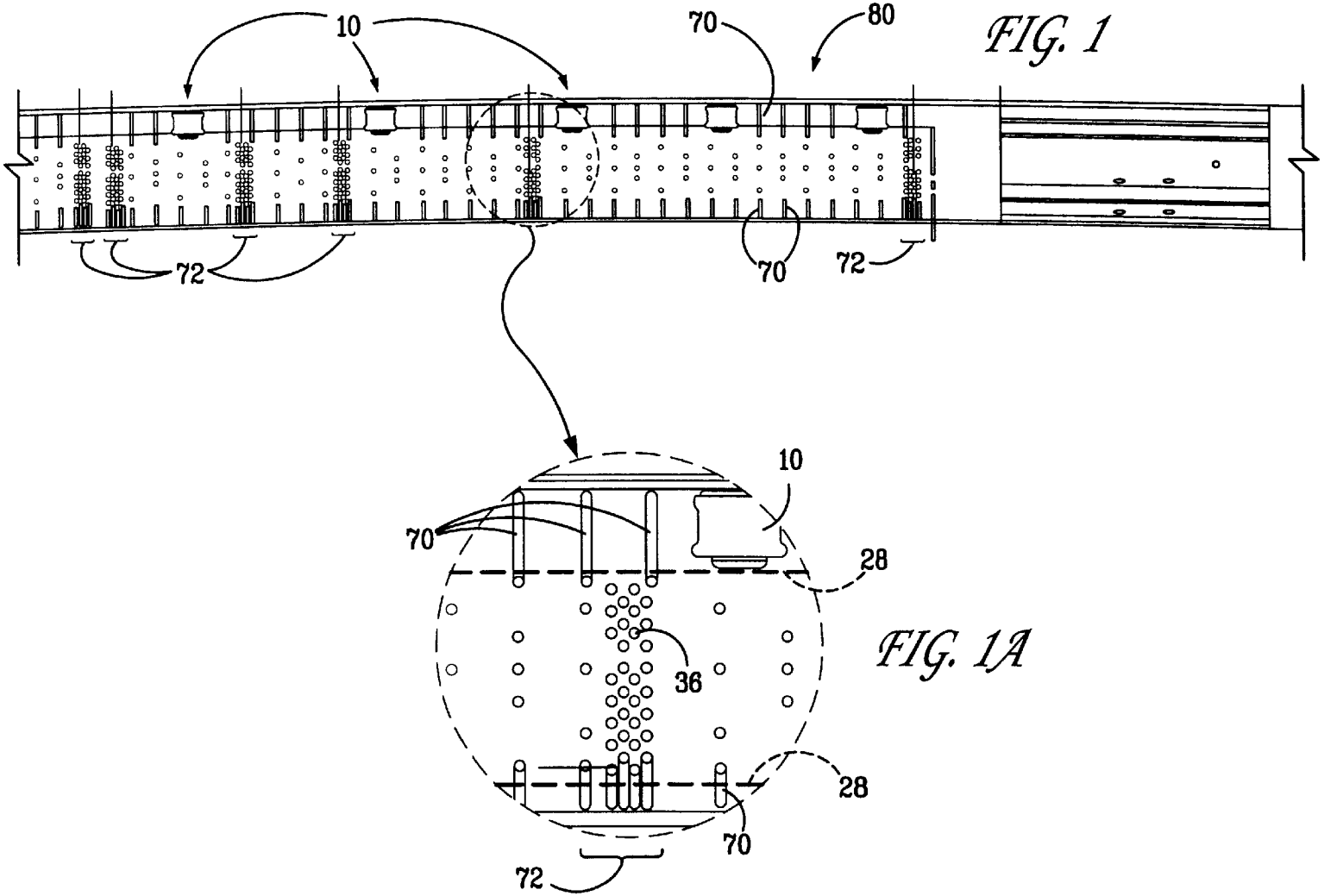
FIGS. 1 and 1A depict a plan view and a detail view, respectively, of a preferred platen embodiment for practicing the present invention wherein detail regarding the vacuum apertures, printing zone, media edge compensation ports, and grit roller assembly are shown.

The present invention is first described primarily with reference FIG. 1, wherein media-receiving surface of a platen 80 which preferably forms a part of a large format ink jet print engine (not shown) are depicted. The platen 80 has a printing zone 28 which is defined as an area where ink droplets can be emitted from ink jet pens (not shown) during printing operations of engine. The printing zone 28 is populated with a plurality of platen apertures, or ports 36, which are fluidly coupled to an evacuated compartment 73. The platen 80 is adapted to receive a set of roller bearings 10 coupled to an axial shaft (not shown) for propelling a printing media (not shown) through the printing zone 28. The inventor notes that any friction/nip roller sets should be located as close to the printing zone as possible but should not be located so close to an edge of a printing media that cupping of the media might occur when the media should 'walk' toward said friction/nip rollers sets. Also, such friction/nip roller sets should not intrude into any of the fluidly sealed compartments described herein but such roller sets can be spaced very closely to the printing zone and the inventive grooved aperture features taught herein allows suction force to be drawn around the perimeter of said roller set locations to thereby tightly bias the printing media to the platen within (and proximate) to the printing zone.

In the embodiment depicted in FIGS. 1 and 1A, a variety of media widths are accommodated with an increased population area 72 of vacuum apertures 36 are formed parallel to the direction of media movement and along predicted edge locations of popular large format printing substrates typically having width dimensions of thirty-six inch (36"), forty-eight inch (38"), fifty-two inch (52"), sixty inch (60"), and for some print engines offered by ColorSpan Corporation of Eden Prairie, Minn. seventy-two inches (72"). In the detail shown in the circular window depicted in FIG. 1A, preferred orientation of said population area 72 of vacuum apertures 36 is depicted.

Figure 2:
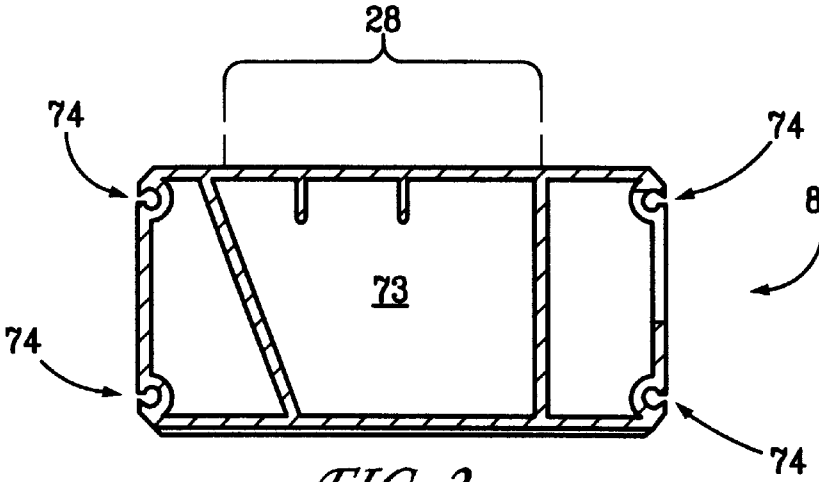
FIG. 2 is elevational cross-section view of a portion of the platen depicting a compartment within the platen where a vacuum is produced (relative to ambient pressure conditions) so that a vacuum seal is promoted between a media traversing the surface of said platen and also depicting a set of grooves formed in the platen which cooperate with a tongue portion of a radiused platen transition section outside of the printing zone of said platen, which is preferably formed as an extrusion of aluminum 80 (Al 80) material.

Referring now to FIG. 2, which is elevational view of a portion of the platen 80 depicting a compartment 73 within the platen 80 where a vacuum is produced (relative to ambient pressure conditions) so that a vacuum seal is promoted between a media traversing the surface printing zone 28 of said platen 80 and also depicting a set of attachment grooves 74 formed at the edges of the platen 80 which cooperate with a tongue portion 76 of a tapering platen transition section 75 (see FIG. 4A) outside of the printing zone 28 of said platen 80.

Recesses or grooves 70 extending from some of the vacuum apertures 36 allow a compartment 73 which is not coterminous with the printing zone 28, or does not fluidly couple directly through a vacuum aperture 36 to the surface of platen 80 to nevertheless provide suction force to a printing media traversing the platen 80. As can be seen in FIGS. 1 and 1A, these grooves 70 also allow a vacuum to be drawn proximate other features disposed upon platen 80 or within printing zone 28 by forming the grooves to reach to the nearest vacuum aperture 36 without altering the compartment 73 or the platen building process or die (if extended).

The apertures 36 may be placed appropriately for the amount of suction force desired, but commonly the apertures 36 are grouped near areas where a printing substrate is expected to end. The apertures 36 may be of different diameter and the grooves 70 may also be varied to achieve desired goals. For example, an x-shaped or v-shaped groove section may be disposed around an aperture 36 at the intersection of the "x" or "v" or more than one aperture 36 may be disposed in a single section of groove if needed.

Figure 3:
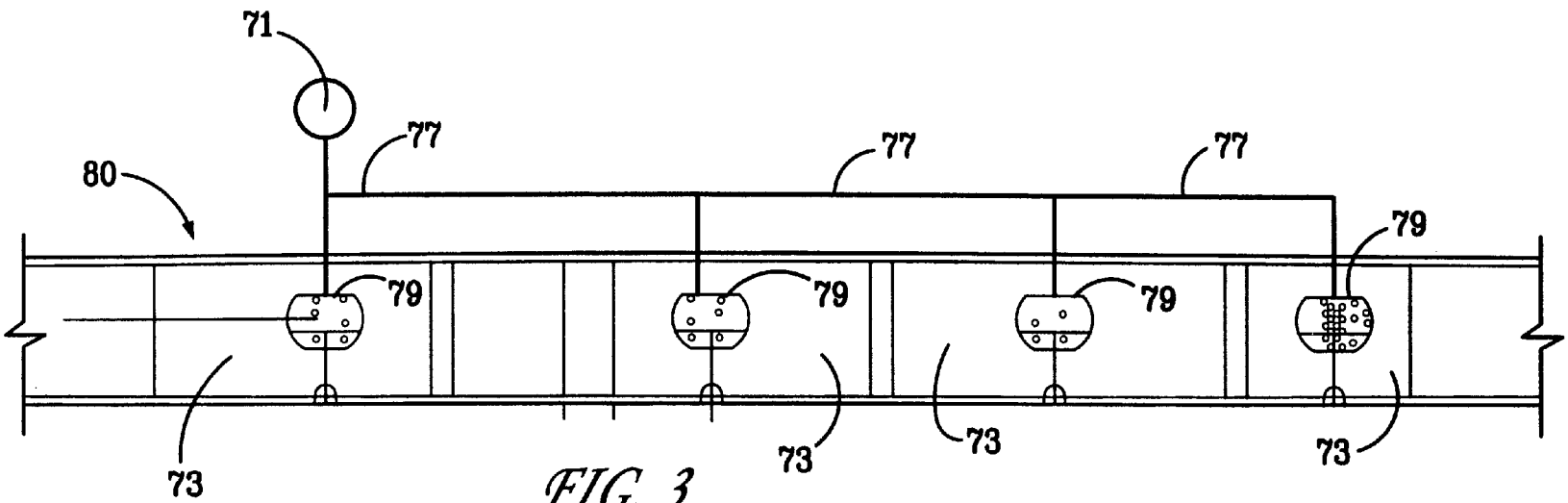
FIG. 3 is a plan view of the lower portion of the preferred platen embodiment depicted in FIG. 1, showing the fan-receiving ports and vapor emission locations of this embodiment of the present invention.
Figure 5:
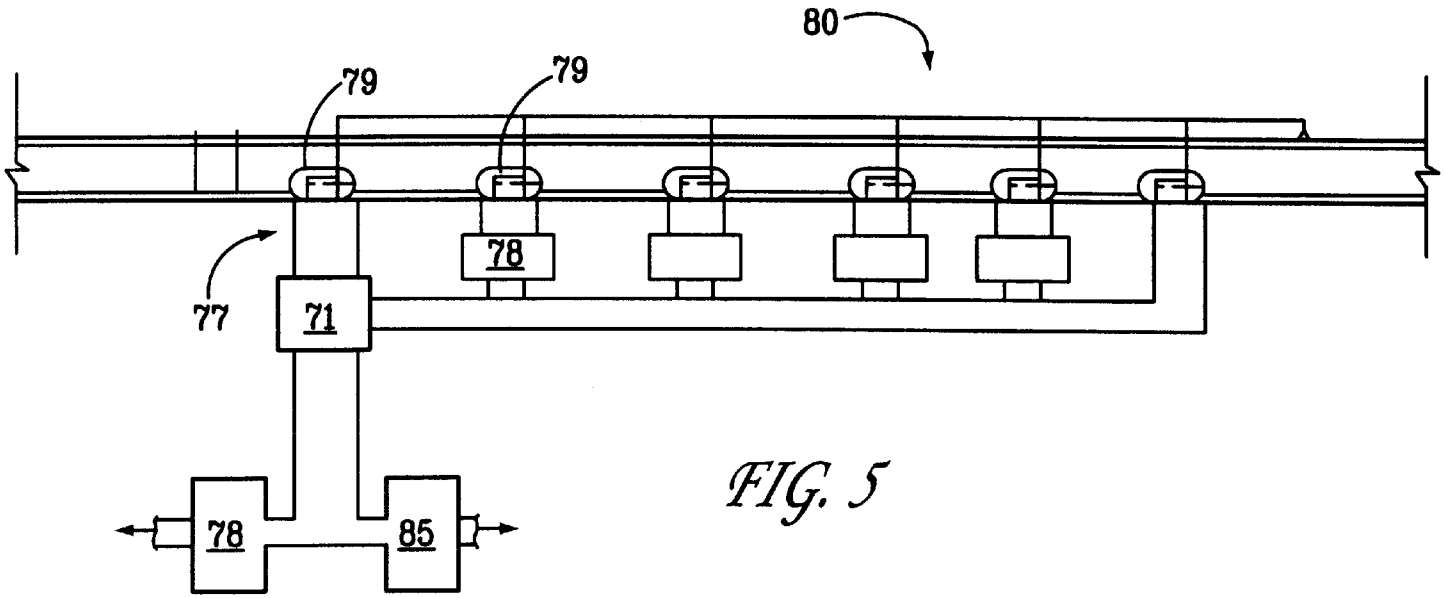
FIG. 5 is a depiction of an embodiment of the present invention wherein the lateral end portions of the platen (outside of the printing zone) are populated with apertures fluidly coupled to separate platen-end compartments and said separate platen-end compartments are commonly fluidly coupled to a single blower.

Referring now to FIG. 3, which is a plan view of the lower portion of the preferred platen embodiment depicted in FIG. 1, showing the fan ports 79 where a fan 71 is disposed and electrically connected to evacuate a compartment 73. When the fan 71 is operating each vacuum aperture 36 which is covered by a portion of printing media exerts a sealing force to the printing media and each vacuum aperture 36 which extends to a groove 70 likewise provides a sealing force over a greater area than a single vacuum aperture 36 alone. In the embodiment depicted in FIG. 3, four fan ports 79 are preferably each formed in a side of a corresponding compartment 73 which is otherwise fluidly sealed tight. Thus, only one fan 71 operates to evacuate each compartment 73. As depicted in FIGS. 3 and 5, one or more fans 71 may be disposed in a fluid evacuation tube 77 which terminates either at an exhaust vent 85, a vapor capture vessel 78, or other suitable filtering or discharge apparatus. Of course, gaps and spaces that may exist in the engine and particularly in and near the printing zone of print engine should be filled or otherwise sealed to promote evacuation of the interior spaces thereof. Notably, the compartments 73 do not encompass the grit/nip roller sets 10 but grooves 70 can reach areas immediately proximate the roller sets 10.

In the embodiments wherein a vapor capture vessel 78 is fluidly coupled to the discharged fluid produced by a fan 71 periodic replacement of a vapor-containing media typically disposed therein will likely be required. Thus, vessel 78 is preferably located for ease of access, inspection, and replacement by an operator of the engine. While not depicted, the inventor suggests that the print engine utilize a timing mechanism or ink usage data, if available, to indicate to the operator of engine that the vessel 78 needs attention. Vessel 78 (and any vapor-containing media therein) should be designed to practice demonstrated, appropriate vapor recovery techniques to capture any potentially harmful vapors or print-artifact producing dust particles. In these embodiments, a suitable recovery technique might include fume incinerator(s), carbon absorbers, HEPA-quality filter materials, phase change recovery, and the like.

Thus, in the embodiment depicted in FIGS. 1, 2 and 3, the inventive apparatus allows a high degree of control over the printing substrate within the printing zone 28 by extending the effective "reach" of certain vacuum apertures 36, 70 near the periphery of the printing zone 28 without requiring extensive under-platen compartments while providing exceedingly consistent printing performance for each print head operating in a large format ink jet printer.

Figure 4B:
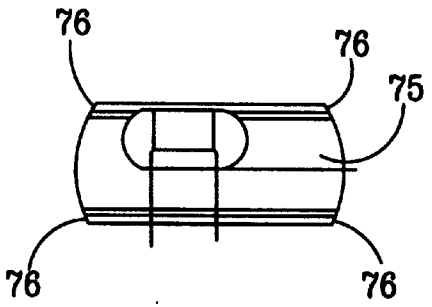
FIGS. 4A and 4B show enlarged views of a set of platen recesses shaped to maximize fluid seal for various locations on and near fixtures disposed on the platen.
Figure 4A:
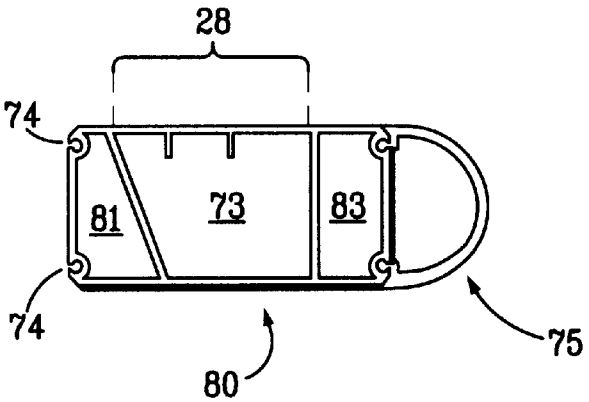

Referring now to FIGS. 4A and 4B, which are enlarged views of a set of platen recesses shaped to maximize fluid seal for various locations on and near fixtures disposed on the platen. For example, interior compartment 73 is the preferred compartment to which a blower assembly (e.g., a fan) and a set of apertures are fluidly coupled. Also depicted in FIG. 4A are two additional chambers 81, 83 which are typically not fluidly sealed but are rather used to conduct electrical wiring conduit and for mounting an axial shaft the full length of the platen. In either case, a number of service panel cut-outs preferably allow manual access to these areas of the platen. One advantage of the inventive grooved vacuum apertures of the present invention is that a vacuum maintained within the compartment 73 can be distributed above adjacent, unsealed "compartments" 81, 83 to reach advantageous locations around platen-surface features such as friction/nip rollers attached to a single axial shaft used for media handling. Also the platen extension 75 (shown on only one side of the platen member in FIG. 4A) is shown attached to the platen member. The platen extension 75 is typically not provided with a source of vacuum or with apertures but simply provides a gradual transition for the printing media as it traverses the platen to minimize 'kinks' in the media that can cause damaging head strikes and printing irregularities.

Referring to FIG. 5, which is a diagram depicting the vapor recovery apparatus 77, 78 coupled to specialized fluid end-ports 79 which are coupled to a single blower or fan 71 and where said end-ports 79 are typically disposed adjacent to the printing zone 28. The end-ports 79 can then be fluidly coupled to vapor containment vessels 78 as described above. Thus, in this embodiment the lateral end portions of the platen (outside of the printing zone) can either be commonly fluidly coupled to a single vapor recovery vessel or can be commonly vented to atmosphere.

The following examples are intended to convey a few practical implementations of the present invention in a form that briefly and concisely conveys the salient elements of the invention disclosed, taught, enabled, and disclosed herein. Other forms of the present invention may be readily realized following exposure to the present disclosure, and the following examples are not to inhibit or narrow the full scope and breadth of the invention claimed herein. The full scope and breadth of the present invention shall be only limited by the claims appended hereto, including insubstantial variations and equivalents thereof.

EXAMPLE 1

An improved platen apparatus, comprising:

a platen member having a set of apertures formed through a media-receiving surface portion of said platen;

at least one compartment fluidly coupled to said apertures on one side and fluidly coupled to a blower or fan port on another side; and a fan disposed in the blower or fan port and oriented to evacuate said compartment when the blower or fan is energized;

wherein at least a portion of said set of apertures terminates within an elongate recess formed in said media-receiving portion of said platen.

EXAMPLE 2

An improved platen apparatus, comprising:

a platen member having a set of apertures formed through a media-receiving surface portion of said platen;

at least one compartment fluidly coupled to said apertures on one side and fluidly coupled to a blower port on another side;

a blower disposed in the blower port and oriented to evacuate said compartment when the blower is energized; and a vapor recovery vessel fluidly coupled to said blower port so that any vapors or dust evacuated through the set of apertures and into the compartment are receiving in said vapor recovery vessel;

wherein at least a portion of said set of apertures terminates within an elongate recess formed in said media-receiving portion of said platen.

EXAMPLE 3

An improved platen apparatus, comprising:

a platen member having a set of apertures formed through a media-receiving surface portion of said platen throughout a printing zone on said media-receiving portion of said platen;

at least one compartment fluidly coupled to said apertures on one side and fluidly coupled to a blower port on another side; and a fan disposed in the fan port and oriented to evacuate said compartment when the fan is energized;

wherein each number of at least a portion of said set of apertures terminates within a corresponding number of elongate recesses formed in said media-receiving portion of said platen and wherein a majority of said set of apertures are disposed near the periphery of said platen.

EXAMPLE 4

An improved platen apparatus, comprising:

a platen member having a set of apertures formed through a media-receiving surface portion of said platen throughout a printing zone on said media-receiving portion of said platen;

a set of at least four compartments fluidly coupled to a subset of said set of apertures on one side, wherein each one of said set of four compartments are each fluidly coupled to a single blower port on another side of each said compartment; and a blower disposed in each single blower port and oriented to evacuate each said compartment when the blower is energized;

wherein each number of at least a portion of said set of apertures terminates within a corresponding number of elongate recesses formed in said media-receiving portion of said platen and each of said elongate recesses terminates near a periphery of said printing zone.

EXAMPLE 5

An improved platen apparatus, comprising:

a platen member having a set of apertures formed through a media-receiving surface portion of said platen throughout a printing zone on said media-receiving portion of said platen;

at least one compartment fluidly coupled to said apertures on one side and fluidly coupled to an fan port on another side; and a fan disposed in the fan port and oriented to evacuate said compartment when the fan is energized; and a filter means coupled to the fan for removing particulate material when the fan is energized;

wherein each number of at least a portion of said set of apertures terminates within a corresponding number of elongate recesses formed in said media-receiving portion of said platen.

Although that present invention has been described with reference to discrete embodiments, no such limitation is to be read into the claims as they alone define the metes and bounds of the invention disclosed and enabled herein. One of skill in the art will recognize certain insubstantial modifications, minor substitutions, and slight alterations of the apparatus and method claimed herein, that nonetheless embody the spirit and essence of the claimed invention without departing from the scope of the following claims.

What is claimed is:

1. An improved platen apparatus, comprising:

an elongate platen member;

a set of apertures in said platen member that join a top surface and a bottom surface of said platen member;

a media-receiving surface portion on said top surface of said platen member;

elongated grooves formed in said top surface of said platen member extending generally in a direction of media travel over said platen member;

at least one compartment coupled to said apertures on one side, said at least one compartment having a fan port formed in another side of said at least one compartment; and at least one fan coupled to said fan port and adapted to evacuate said compartment when said at least one fan is energized;

wherein at least a subset of said set of apertures couple said media-receiving surface portion of said platen member to said at least one compartment within said elongated grooves formed in said media-receiving portion of said platen.

2. The apparatus of claim 1, wherein a majority of said elongated grooves are formed proximate a periphery of said platen member extending toward a periphery of said platen member and toward a long side of said platen member.

3. The apparatus of claim 1, wherein said platen member further comprising a tapered platen transition section, wherein said tapered platen transition section gradually tapers at at least one long side of said platen member with a continuing radius surface portion of said platen member.

4. The apparatus of claim 1, further comprising a printing zone that contains a majority of said set of apertures.

5. The apparatus of claim 4, further comprising at least one additional set of apertures, a second compartment, and a second fan all operating outside of the printing zone.

6. The apparatus of claim 5, wherein the second fan is fluidly coupled to a duct;

and wherein said duct terminates at a first end; and wherein said first end is adapted to receive a recovery vessel.

7. The apparatus of claim 6, wherein the vessel is filled with an activated charcoal means for retaining volatile organic compounds.

8. The apparatus of claim 1, further comprising a plurality of increased population areas of apertures, wherein each of said plurality of increased population areas of apertures are formed generally parallel to said direction of media travel and along predetermined locations corresponding to width dimensions of standard large format printing media.

9. The apparatus of claim 4, further comprising a set of grit rollers disposed in portals in a media drive area on said top surface of said platen member outside of said printing zone, wherein at least a subset of said elongated grooves extend into said media drive area.

10. The apparatus of claim 1, wherein said media receiving surface portion comprises a printing zone, and said printing zone is defined by an area where ink droplets are emitted onto said media during printing operations, wherein said at least one compartment is not coterminous with said printing zone, and wherein said grooves extend at least over said printing zone and allow said at least one compartment to provide a suction force via one or more apertures to said media traversing said platen member.

11. The apparatus of claim 1, wherein said grooves comprise one or more of a linear shape, an x-shape, and a v-shape.

12. The apparatus of claim 1, further comprising:

a plurality of compartments each fluidly coupled to a subset of said set of apertures and a subset of said fan port, wherein each of said plurality of compartments is fluidly sealed;

a fan fluidly coupled to each of said plurality of compartments and adapted to evacuate said corresponding compartment when said fan is energized;

a fluid evacuation tube fluidly coupled to each of said fans; and one or more of a vapor capture vessel and an exhaust vent fluidly coupled to said fluid evacuation tube.

13. An improved platen apparatus, comprising:

an elongate platen member;

a set of apertures that join a top surface and a bottom surface of said platen member, and wherein said top surface is a media-receiving surface portion of said platen member throughout a printing zone on said media-receiving portion of said platen;

elongated grooves formed in said platen member extending toward a periphery of said platen member, wherein each of said grooves extends into said top surface of said platen member toward said bottom surface, but not through to said bottom surface;

wherein at least one aperture extends into each of said grooves;

at least one compartment coupled to said apertures on one side, said at least one compartment having a fan port formed in another side of said at least one compartment; and a fan disposed in said fan port and oriented to evacuate said compartment when the fan is energized.

14. The improvement of claim 13, wherein said at least one compartment further comprises dividing walls that sealingly separate said at least one compartment into at least four compartments;

wherein each of said at least four compartments are each fluidly coupled to a subset of said set of apertures;

wherein each of said at least four compartments has a fan port; and wherein each of said fan ports is formed and adapted to receive a fan oriented to evacuate each of said at least four compartments.

15. The improvement of claim 13, further comprising a sealed length of tubing coupled to each fan at a first end; and a vapor recovery vessel coupled to said length of tubing at a second end.

* * * * *